US011852030B2

(12) United States Patent
Richner

(10) Patent No.: US 11,852,030 B2
(45) Date of Patent: Dec. 26, 2023

(54) TURBINE CASING COMPRISING A LOW-STRESS CONNECTION FLANGE, AND EXHAUST-GAS TURBINE HAVING SUCH A TURBINE CASING

(71) Applicant: Turbo Systems Switzerland Ltd, Baden (CH)

(72) Inventor: Matthias Richner, Gebenstorf (CH)

(73) Assignee: Turbo Systems Switzerland Ltd, Baden (CH)

( * ) Notice: Subject to any disclaimer, the term of this patent is extended or adjusted under 35 U.S.C. 154(b) by 85 days.

(21) Appl. No.: 17/627,380

(22) PCT Filed: Jun. 22, 2020

(86) PCT No.: PCT/EP2020/067326
§ 371 (c)(1),
(2) Date: Jan. 14, 2022

(87) PCT Pub. No.: WO2021/008816
PCT Pub. Date: Jan. 21, 2021

(65) Prior Publication Data

US 2022/0268177 A1 Aug. 25, 2022

(30) Foreign Application Priority Data

Jul. 15, 2019 (EP) ..... 19186327

(51) Int. Cl.
*F01D 25/16* (2006.01)
*F01D 25/24* (2006.01)

(52) U.S. Cl.
CPC ..... *F01D 25/243* (2013.01); *F01D 25/162* (2013.01); *F05D 2220/40* (2013.01); *F05D 2240/14* (2013.01); *F05D 2240/15* (2013.01); *F05D 2260/31* (2013.01)

(58) Field of Classification Search
None
See application file for complete search history.

(56) References Cited

U.S. PATENT DOCUMENTS

| | | | | |
|---|---|---|---|---|
| 7,008,182 | B2 * | 3/2006 | Kopp | F01D 25/243 415/213.1 |
| 9,512,740 | B2 * | 12/2016 | Orosa | F01D 25/30 |
| 9,856,753 | B2 * | 1/2018 | Chow | F01D 25/24 |
| 2015/0143814 | A1 | 5/2015 | Orosa et al. | |

FOREIGN PATENT DOCUMENTS

| | | | |
|---|---|---|---|
| EP | 1273760 | A1 | 1/2003 |
| EP | 3103972 | A1 | 12/2016 |

OTHER PUBLICATIONS

International Search Report for corresponding International App. No. PCT/EP2020/067326, dated Jul. 28, 2020, 2 pages.

* cited by examiner

*Primary Examiner* — Todd E Manahan
*Assistant Examiner* — Sean V Meiller
(74) *Attorney, Agent, or Firm* — Armstrong Teasdale LLP

(57) ABSTRACT

A turbine casing for an exhaust-gas turbine is provided herein. The turbine casing has a connection flange for bearing-casing-side attachment to a bearing casing in which casing-connection holes that are mutually spaced in the circumferential direction are provided, wherein, between adjacent casing-connection holes, material recesses that are open radially inwards towards a central longitudinal axis of the turbine casing are provided in the connection flange. Further provided herein is an exhaust-gas turbine that is equipped with the turbine casing.

15 Claims, 4 Drawing Sheets

TURBINE CASING COMPRISING A LOW-STRESS CONNECTION FLANGE, AND EXHAUST-GAS TURBINE HAVING SUCH A TURBINE CASING

CROSS-REFERENCE TO RELATED APPLICATIONS

The present disclosure is a National Stage Entry of International Patent Application No. PCT/EP2020/067326, filed Jun. 22, 2020, which claims priority to European Patent Application No. 19186327.3, filed Jul. 15, 2019, the entire contents of which are each incorporated in their entirety herein.

TECHNICAL FIELD OF THE DISCLOSURE

The disclosure relates to a turbine casing including a low-stress connection flange, and to an exhaust-gas turbine having such a turbine casing. The exhaust-gas turbine can be, for example, a turbocharger turbine for a turbocharger or a power turbine.

BACKGROUND

US 2015/0143814 A1 discloses a one-piece exhaust system of a gas turbine. This exhaust system has a turbine outlet casing and a turbine exhaust manifold, wherein the turbine outlet casing is connected to the turbine exhaust manifold at outwardly directed interface flanges. This makes it possible, if necessary, to detach the turbine exhaust manifold from the turbine outlet casing by simple decoupling and to replace it with a new component.

EP 3 103 972 A1 discloses a gas turbine in which a high-pressure turbine casing is connected to a diffuser casing at outwardly directed flanges.

EP 1 273 760 A1 discloses a turbocharger in which sealing means are arranged between a turbine inlet spiral and a turbine nozzle ring defining a circular passage.

A typical turbocharger has a turbine casing, a bearing casing and a compressor casing, wherein the turbine casing is connected to the bearing casing, and the bearing casing is furthermore connected to the compressor casing.

The connection between the turbine casing and the bearing casing must meet several requirements. These requirements include ensuring gas-tightness, preventing twisting between the two casings due to external forces and ensuring the cohesion of the two casings even in the event of a burst. In order to be able to meet these requirements, the connection between the turbine casing and the bearing casing must, in particular, be designed in such a way that it can cope with large temperature differences between the turbine casing and the bearing casing and with high forces in the event of a burst. Reliable containment is a very important and therefore structurally very demanding requirement for an exhaust-gas turbine in such a bursting situation.

The practice of connecting a turbine casing to a bearing casing using a clamping ring that connects an end section of a flange of the turbine casing to an end section of a flange of the bearing casing that rests against the end section of the flange of the turbine casing is already known. Such a clamping ring connection is used, in particular, in comparatively low-power turbochargers. One disadvantage of such a clamping ring connection is that it cannot guarantee the cohesion of the casings in the event of a burst, in which high forces come into effect.

In the case of higher-power turbochargers, for example those with more than 500 KW of engine power per turbocharger, connection of the turbine casing to the bearing casing using a turbine casing flange equipped with clamping lugs has become established in practice. Screws, for example, are passed through these clamping lugs, and these screws are screwed into threaded bores in the turbine casing and press said clamping lugs against the turbine casing and the bearing casing adjoining the latter, as a result of which the bearing casing is also pressed against the turbine casing. When such a clamping lug flange is used, a comparatively large penetration depth of the screws into the turbine casing is required owing to the powerful forces when a burst occurs. In order to be able to provide this large penetration depth of the screws, it is necessary to select a correspondingly large thickness dimension for the connection flange of the turbine casing. This large thickness of the connection flange on the one hand increases the rigidity of the connection flange, but on the other hand causes comparatively slow and also non-uniform heating of the connection flange of the turbine casing. This increases the thermal-transient stresses in the turbine casing, particularly in the region of the connection flange, but also in the region of the tongue of the turbine casing. The higher thermal-transient stresses in turn lead to a reduced service life of the turbine casing and thus also of the entire turbocharger.

FIG. 1 shows a first sectional view intended to illustrate a turbine casing according to the prior art. This turbine casing has a connection flange 2, via which the turbine casing 1 is connected to the bearing casing 14 of a turbocharger. This connection is made using connection elements which are screwed into casing-connection bores of the connection flange and press clamping lugs 16 onto the connection flange 2 of the turbine casing 1 and onto the bearing casing 14 by means of nuts 17, as a result of which the bearing casing 14 is furthermore pressed onto the turbine casing. Said casing-connection bores are mutually spaced (i.e. at a distance from one another in space) and are arranged in the circumferential direction along a circle. The clamping lugs are likewise arranged in the circumferential direction of the turbine casing along a circle. Since, as explained above, the requirements on the connection between the turbine casing and the bearing casing are high, the penetration depth of the connection elements into the connection flange must be large. This, in turn, requires a comparatively large flange thickness 19 of the connection flange 2 in the region of the connection between the turbine casing and the bearing casing.

FIG. 2 shows a second sectional view intended to illustrate a turbine casing according to the prior art. This second sectional view illustrates the turbine casing at an interface at which a connection element 15 is screwed into a casing-connection bore 3 in the connection flange 2 of the turbine casing. FIG. 2 also shows that a clamping lug 16 is pressed both onto the turbine casing 2 and onto the bearing casing 14, this being achieved by using a nut 17 and a washer 18.

BRIEF DESCRIPTION OF THE DISCLOSURE

The present disclosure provides a turbine casing and an exhaust-gas turbine in which the disadvantages mentioned above with reference to a turbocharger are reduced.

The turbine casing and the exhaust-gas turbine include the features described herein.

A turbine casing as described herein has a connection flange for bearing-casing-side attachment to a bearing casing, in which casing-connection bores that are mutually spaced in the circumferential direction are provided, wherein, between mutually adjacent casing-connection bores, material recesses that are open radially inward toward a central longitudinal axis of the turbine casing are provided in the connection flange. The turbine casing may also be of multi-part construction, and a heat shield or a nozzle ring can be arranged between the turbine casing and the bearing casing.

Throughout this description, the term "bore" should in all cases be interpreted functionally and not, based on the way it is produced, with reference to mechanical machining by means of a drilling machine or milling machine.

According to one embodiment of the disclosure, the mutually spaced casing-connection bores in the connection flange are arranged along at least one circle.

According to one embodiment of the disclosure, the turbine casing has a clamping edge arranged adjacent to the casing-connection bores in the radial direction.

According to one embodiment of the disclosure, an annular depression is provided in the clamping edge, which has a depression bottom, wherein the adjacent casing-connection bores are introduced into the depression bottom, and wherein the material recesses provided between in each case two adjacent casing-connection bores are provided in the depression bottom.

According to one embodiment of the disclosure, the clamping edge has, in the region between two adjacent casing-connection bores, a respective clamping edge recess that widens the annular depression.

According to one embodiment of the disclosure, the depth of the clamping edge recess coincides with the sum of the depth of the annular depression and the depth of the material recesses provided in the annular depression.

According to one embodiment of the disclosure, the turbine casing is of multi-piece design.

According to one embodiment of the disclosure, the clamping edge forms a separate part of the turbine casing.

According to one embodiment of the disclosure, a heat shield or a nozzle ring forms a separate part of the turbine casing.

According to one embodiment of the disclosure, the clamping edge is part of the heat shield or of the nozzle ring.

According to one embodiment of the disclosure, an exhaust-gas turbine has a turbine casing having the features according to the disclosure.

According to one embodiment of the disclosure, an exhaust-gas turbine has a bearing casing connected to the turbine casing, wherein the turbine casing is connected to the bearing casing by means of connection elements.

According to one embodiment of the disclosure, an exhaust-gas turbine has clamping elements that are each pressed against the connection flange of the turbine casing and against the bearing casing by one connection element or by a plurality of connection elements.

According to one embodiment of the disclosure, the clamping elements of the exhaust-gas turbine are pressed against the clamping edge.

In an embodiment, the connection elements are screws or threaded pins.

The advantages of the disclosure are, in particular, that the material recesses provided between the casing connection bores permit faster and more uniform heating of the connection flange region during operation of the respective exhaust-gas turbine. By virtue of these material recesses, there is furthermore reduced rigidity of the turbine casing in the region of the connection flange. As a result, lower thermal-transient stresses occur during operation of the exhaust-gas turbine. This in turn leads to an extension of the service life of the turbine casing and thus also to an extension of the service life of the entire exhaust-gas turbine.

DETAILED DESCRIPTION OF THE DISCLOSURE

Figure 3:
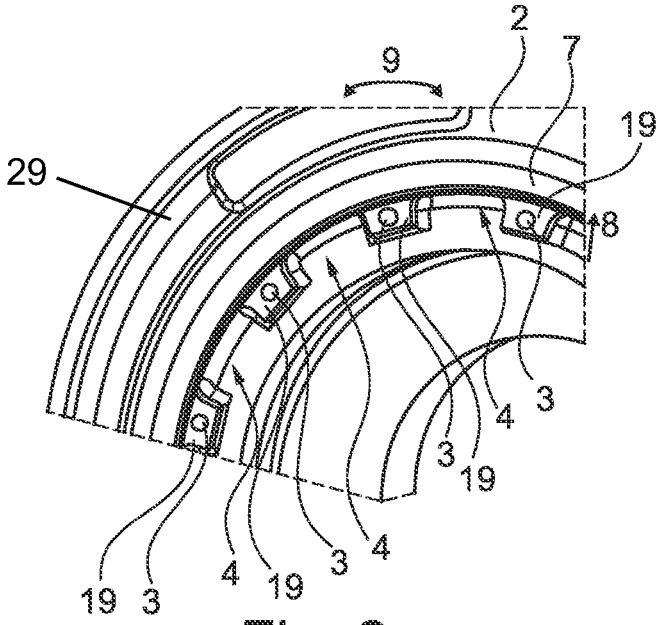
FIG. 3 shows a diagram intended to illustrate a turbine casing according to the disclosure.

FIG. 3 shows a diagram intended to illustrate a turbine casing 29 according to the disclosure, wherein only a partial region of this turbine casing is illustrated in FIG. 3. The turbine casing has a connection flange 2, which is arranged coaxially with a longitudinal central axis of the turbine casing and is equipped with a clamping edge 7. Provided in this clamping edge 7 are connection webs 19 which extend inward in the radial direction 8 and into which casing-connection bores 3 are introduced. Said connection webs 19 and thus also the casing-connection bores 3 introduced therein are mutually spaced in the circumferential direction 9 of the turbine casing. They are arranged in the circumferential direction 9 along one or more circles in the connection flange. Between in each case two casing-connection bores 3 mutually spaced in the circumferential direction 9, material recesses 4 which are open radially inward are provided in the clamping edge 7 of the connection flange 2. These material recesses 4 can be introduced into the clamping edge of the connection flange by material removal or can be modeled directly if a forming manufacturing method is used. Different geometries can be selected for the material recesses. For example, the material recesses can be semicircular, elliptical, bell-shaped or rectangular.

Figure 1:
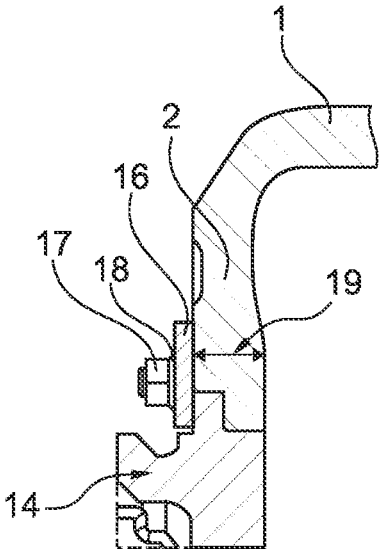
Prior Art Fig. 1
FIG. 1 shows a first sectional view intended to illustrate a prior art turbine casing.
Figure 2:
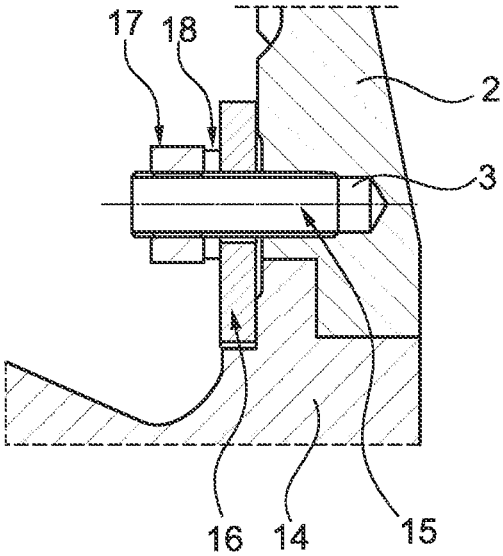
Prior Art Fig. 2
FIG. 2 shows a second sectional view intended to illustrate a prior art turbine casing.

A connection of the turbine casing to a bearing casing (not illustrated in FIG. 3) of a turbocharger is made in the same way as explained above in connection with FIG. 2, using connection elements which are in each case introduced into a casing-connection bore 3 of the connection flange 2, wherein clamping elements which are arranged in the circumferential direction of the turbine casing along a circle and which, in one embodiment, are clamping lugs are furthermore pressed both onto the turbine casing and onto the bearing casing, this in each case being achieved using a nut and a washer.

During the operation of the turbocharger, the material recesses 4 that are provided in contrast to the prior art cause faster and more uniform heating of the connection flange 2 of the turbine casing. Furthermore, owing to the material recesses 4 introduced into the connection flange 2, there is reduced rigidity of the turbine casing in the region of the connection flange 2. This, in turn, has the result that reduced thermal-transient stresses occur in the region of the connection flange 2 in comparison with the prior art. By virtue of this reduction in the thermal-transient stresses in the region of the connection flange, the service life of the turbine casing and thus also the service life of the entire turbocharger are extended.

Figure 4:
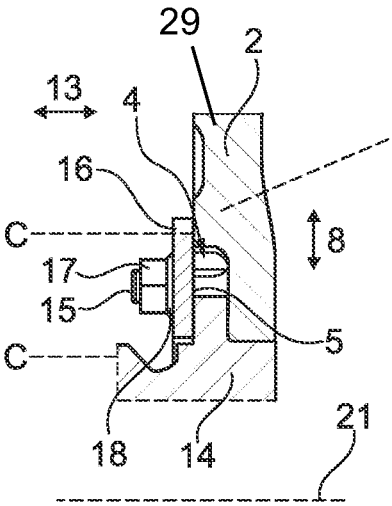
FIG. 4 shows a sectional view in the radial direction intended to illustrate an embodiment of the disclosure.

FIG. 4 shows a sectional view in the radial direction intended to illustrate an embodiment of the disclosure. The connection flange 2 of the turbine casing 29 and the bearing casing 14 connected to the connection flange 2 and thus to the turbine casing are illustrated. It can furthermore be seen from FIG. 4 that the connection of the turbine casing to the bearing casing in the section plane illustrated is achieved using a clamping lug 16. This clamping lug 16 is pressed onto the connection flange 2 of the turbine casing and onto the bearing casing 14. This pressure is achieved using a nut 17 and a washer 18 arranged between the nut 17 and the clamping lug 16. It is furthermore apparent from FIG. 4 that, by means of this pressure, the bearing casing is pressed against the connection flange 2 of the turbine casing since the bearing casing 14 has a clamping edge which is directed radially outward, i.e. upward in FIG. 4, and the rear side of which is pressed onto an extension of the connection flange 2 which is directed inward in the radial direction, i.e. downward in FIG. 4. Finally, it is also possible to see from FIG. 4 one of the recesses 4 illustrated in FIG. 3, which is provided in the axial direction between the clamping lug 16 and the connection flange 2 in the section plane shown in the interconnected state of the turbine casing and the bearing casing.

Figure 5:
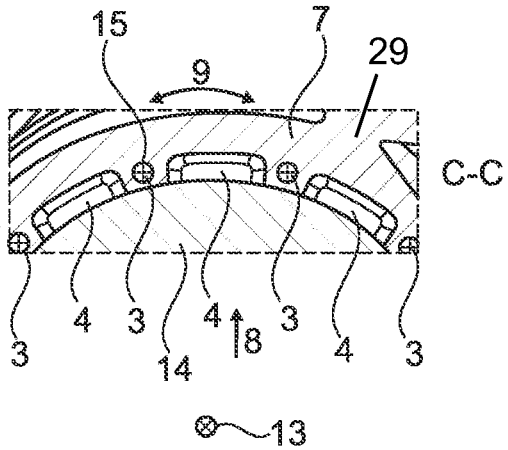
FIG. 5 shows a sectional view along section line C-C shown in FIG. 4.

FIG. 5 shows a sectional illustration according to section line C-C shown in FIG. 4. From this illustration, it is possible to see, in particular, that material recesses 4 are provided in the clamping edge 7 of the connection flange 2 of the turbine casing 29 between in each case two casing-connection bores 3 spaced apart in the circumferential direction 9, into which connection elements 15 are introduced, said material recesses being situated outside the bearing casing 14 in the radial direction 8 and being open radially inward in the section plane shown.

Figure 6:
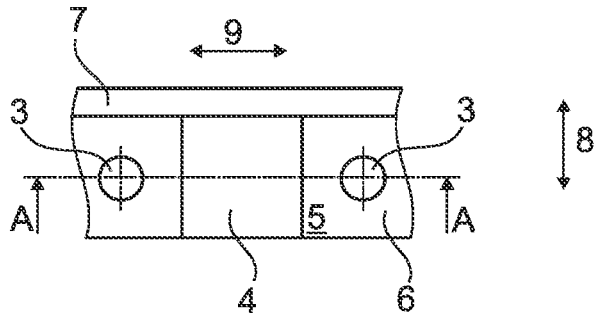
FIG. 6 shows a diagram intended to illustrate another embodiment of the disclosure.

FIG. 6 shows a diagram intended to illustrate another embodiment of the disclosure. In this other embodiment, an annular depression 5 which extends in the circumferential direction 9 over the entire circumference of the turbine casing 29 is provided in the radially inner edge region of the clamping edge 7 of the connection flange 2 of the turbine casing. This annular depression 5 has a depression bottom 6.

In this embodiment of the disclosure, the casing-connection bores 3 mutually spaced in the circumferential direction 9 are introduced into the depression bottom 6 of the annular depression 5.

Furthermore, in this embodiment, the material recesses 4 provided between in each case two adjacent casing-connection bores 3 are likewise introduced into the depression bottom 6 of the annular depression 5. These material recesses 4 extend in the radial direction 8 over the entire depression bottom 6.

By introducing the casing-connection bores 3 and the material recesses 4 into the depression bottom 6 of the annular depression 5, the thickness of the connection flange 2 of the turbine casing in the connection region of the turbine casing to the bearing casing and thus the thermal-transient stresses occurring in the connection flange 2 during the operation of the turbocharger are further reduced.

Figure 7:
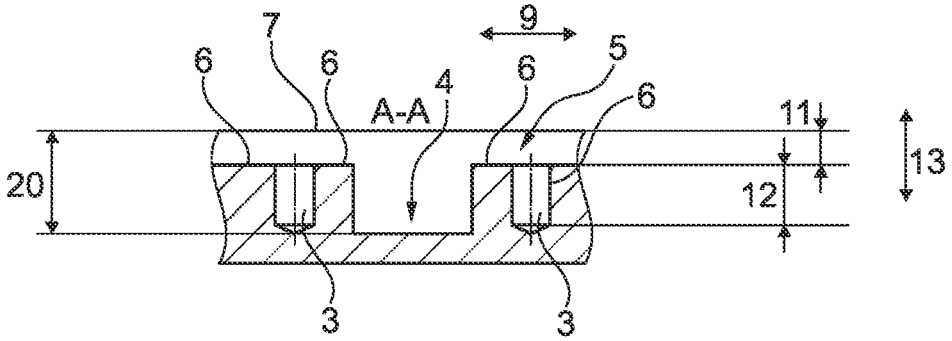
FIG. 7 shows a sectional view in the direction of section line A-A shown in FIG. 6.

FIG. 7 shows a sectional view in the direction of section line A-A shown in FIG. 6. In said FIG. 7, the depth of the casing-connection bores 3 introduced into the depression bottom 6 is denoted by the reference numeral 12. It is furthermore apparent that in this embodiment the depth of the material recesses 4 coincides with the depth 12 of the casing-connection bores 3 introduced into the depression bottom 6. According to other embodiments, the depth of the material recesses 4 may also differ from the depth of the casing-connection bores 3. The depth of the annular depression 5 is denoted by the reference numeral 11. The sum of the depth 11 of the annular depression and the depth 12 of the casing-connection bores introduced into the depression bottom is denoted by the reference numeral 20.

Figure 8:
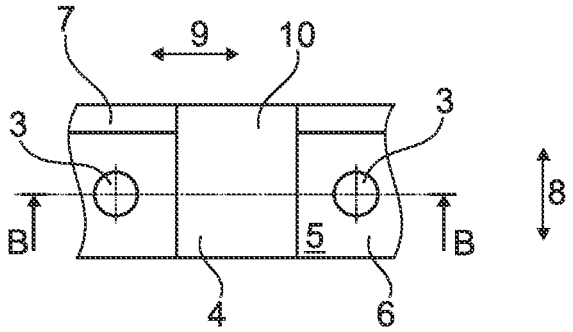
FIG. 8 shows a diagram intended to illustrate another embodiment of the disclosure.

FIG. 8 shows a diagram intended to illustrate a further embodiment of the disclosure. In this further embodiment, an annular depression 5 which extends in the circumferential direction 9 over the entire circumference of the turbine casing 29 is once again provided in the radially inner edge region of the clamping edge 7 of the connection flange 2 of the turbine casing. Once again, casing-connection bores 3 that are mutually spaced in the circumferential direction 9, between which the material recesses 4 are situated, are introduced into the depression bottom 6 of the annular depression 5. These recesses 4 are open inward in the radial direction 8 and extend into the region of the clamping edge 7. Consequently, the clamping edge 7 in this development has clamping edge recesses 10, which are each provided between two mutually adjacent casing-connection bores 3. In the exemplary embodiment shown, these clamping edge recesses 10 extend in the radial direction 8 through the entire clamping edge 7.

Figure 9:
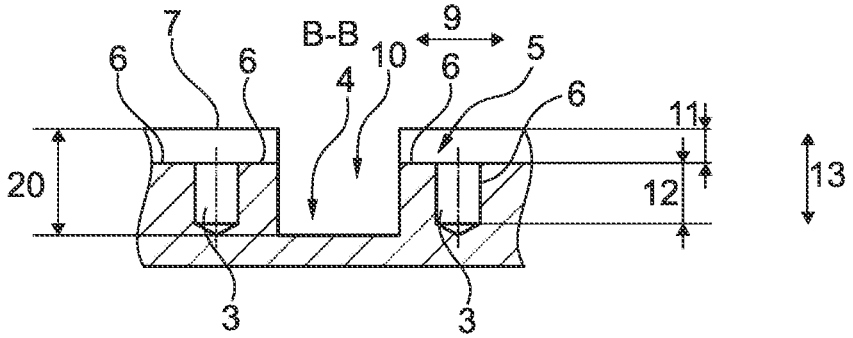
FIG. 9 shows a sectional view in the direction of section line B-B shown in FIG. 8.
Figure 10:
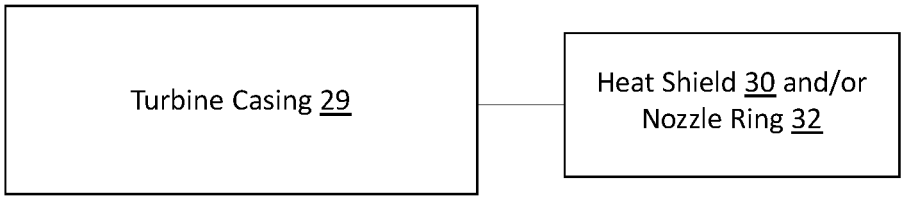
FIG. 10 illustrates a heat shield and/or a nozzle ring coupled to a turbine casing.

FIG. 9 shows a sectional view in the direction of section line B-B shown in FIG. 8. According to said FIG. 9, the clamping edge recess 10 provided in the clamping edge 7 has a first depth 20. This annular depression 5 has a second depth 11. The casing-connection bores 3 introduced into the depression bottom 6 have a third depth 12. In the exemplary embodiment shown, the first depth 20 of the clamping edge recess 10 coincides with the sum of the second depth 11 of the annular depression 5 and the third depth 12 of the casing-connection bore 3 provided in the annular depression 5. Depths 20, 11 and 12 each extend in the axial direction 13 of the turbine casing.

General aspects of the disclosure are described below, wherein the reference signs relate to all of the abovementioned embodiments but what has been stated is not limited to any individual embodiment, instead being susceptible of combination with any desired embodiments and aspects.

According to one aspect, the flange thickness 19 of the connection flange 2 is reduced owing to the recesses 4 and 10 introduced into the connection flange 2 in addition to the casing-connection bores 3, and therefore the thermal-transient stresses occurring in the connection flange 2 are reduced in comparison with the prior art, leading to an extended service life of the turbine casing and thus of the entire turbocharger. This turbocharger has a turbine casing of the kind explained above.

According to another aspect, this turbocharger has a bearing casing connected to the turbine casing, wherein the turbine casing is connected to the bearing casing by means of connection elements 15, which are introduced into the casing-connection bores 3 of the turbine casing and which are, for example, screws or threaded pins.

According to another aspect, the turbocharger has clamping elements which are embodied as clamping lugs 16 and are each pressed against the connection flange 2 of the turbine casing and against the bearing casing 14 by one or more connection elements. In this case, the clamping elements are pressed against a clamping edge of the connection flange. It is also possible to use clamping disks or clamping rings, for example, instead of clamping lugs. The clamping elements may be designed to be at least slightly elastic in order to be able to yield at least slightly when the nuts are tightened.

According to a further aspect, the mutually spaced casing-connection bores 3 in the connection flange 2 are arranged in the circumferential direction along at least one circle, which may be at most three or at most two circles (concentric to one another and/or to the turbine axis) and extend along the entire at least one circle, and may be distributed at regular intervals over the entire circumference of the circle. The number of casing-connection bores required depends on the strength requirements in the event of damage (containment) and on the leaktightness requirements.

According to a further aspect, the mutually spaced casing-connection bores 3 in the connection flange 2 can also be arranged in the circumferential direction along two or more circles, wherein, for example, each second casing-connection bore 3 is arranged along a first circle and each casing-connection bore 3 lying therebetween is arranged along a second circle.

According to one aspect, the flange may have at least five casing-connection bores 3 and/or at least two, and at least four or at least five of the material recesses 4 between mutually adjacent casing-connection bores 3.

According to a further aspect, material recesses 4 are provided between all the casing-connection bores 3. The material recesses 4 are open radially inward. The material recesses 4 may be closed off in the axial direction by a (e.g. annular) rear side of the connection flange, and are therefore not continuous in the axial direction.

As an alternative, material recesses 4 may not be provided between all the casing-connection bores 3 but only where the effect on service life is relevant, e.g. in the region of the inlet into the spiral.

According to one aspect, the flange is arranged coaxially with the longitudinal central axis of the turbine casing.

According to another aspect, the flange is aligned with a bearing casing of the exhaust-gas turbine or is arranged for connection of the turbine casing to the bearing casing (optionally to part of a heat shield and/or of a diffuser ring between the flange and the corresponding part of the bearing casing).

According to one aspect, the recess 4 has an arc length in the circumferential direction of more than half the distance between the centers of the two casing-connection bores 3.

According to one aspect, the connection flange 2 has connection webs 19 which directly surround the casing-connection bores 3, at least in some section or sections, and which are arranged in the circumferential direction between the adjacent casing-connection bores 3 and the material recess 4 lying therebetween.

According to one aspect, the connection flange 2 has a clamping edge 7 arranged adjacent to the casing-connection bores 3 in the radial direction 8.

According to one aspect, the connection webs 19 extend radially inward, starting from the clamping edge 7. The clamping edge can be provided as a separate part of the turbine casing or can be provided integrally with the remainder of the turbine casing or connection flange.

According to one aspect, the turbine casing can be of multi-piece design. In this case, a heat shield 30 or a nozzle ring 32 can form a separate part of the turbine casing. In this case, the clamping edge of the turbine casing can be part of the heat shield 30 or of the nozzle ring 32, i.e. can be integrated into the heat shield 30 or the nozzle ring 32.

According to one aspect, the connection webs are arranged in a manner recessed in the axial direction with respect to the clamping edge 7. In other words, the clamping edge projects beyond the connection webs (e.g. in a direction away from the turbine casing or toward the bearing casing of the exhaust-gas turbine) in the axial direction (e.g. by less than 1 mm or even by a maximum of 0.5 mm and/or by more than 0.1 mm). Accordingly, the connection webs form part of a depression bottom. According to one aspect, the material recesses 4 provided between in each case two adjacent casing-connection bores are arranged in a manner recessed even further in the axial direction with respect to the connection webs.

According to one aspect, the clamping edge can extend continuously (without interruption) in the circumferential direction or can have recesses.

According to one aspect, the connection flange 2 has an annular depression 5, which has a depression bottom 6.

According to one aspect, the adjacent casing-connection bores 3 are introduced into the depression bottoms.

According to one aspect, the material recesses 4 provided between in each case two adjacent casing-connection bores are provided in the depression bottom.

As can be seen from the above explanations, an aspect of the present disclosure may relate to a turbine casing for an exhaust-gas turbine, which turbine casing has a connection flange for bearing-casing-side attachment of the turbine casing to a bearing casing of the exhaust-gas turbine. This connection flange may be a bearing-casing-side side wall of the turbine casing. The side wall of the turbine casing may be designed for direct connection to a turbine-side side wall of the bearing casing, or is connected directly to the turbine-side side wall of the bearing casing. The side wall of the turbine casing may be designed for connection to a turbine-side side wall of the bearing casing by means of a common connection element (penetrating into the casing-connection bores of the turbine casing), for example a connection screw, or is connected to the turbine-side side wall of the bearing casing by means of such a common connection element. According to an aspect, there are no radially outwardly directed connection flanges at the connection point, and/or such connection flanges are not required in order to connect the turbine casing to the bearing casing.

LIST OF REFERENCE SIGNS

1 turbine casing
2 connection flange
3 casing-connection bore
4 material recess
5 annular depression in the connection flange
6 depression bottom
7 clamping edge of the connection flange
8 radial direction
9 circumferential direction
10 clamping edge recess
11 depth of the annular depression 5
12 depth of the casing-connection bores 3
13 axial direction; direction of the longitudinal central axis of the turbine casing
14 bearing casing

15 connection element
16 clamping element
17 nut
18 washer
19 connection web
20 sum of the depth of the annular depression 5 and the depth of the casing-connection bores 3
21 longitudinal central axis of the turbine casing

The invention claimed is:

1. A turbine casing for an exhaust-gas turbine, the turbine casing having a connection flange for bearing-casing-side attachment to a bearing casing, wherein the connection flange defines casing-connection bores that are mutually spaced in a circumferential direction wherein the connection flange further comprises: a clamping edge including a depression bottom, the depression bottom extending in the circumferential direction over an entire circumference of the connection flange and positioned in a radially inner edge region of the clamping edge, the depression bottom defining an annular depression and material recesses, wherein the material recesses have a depth into the depression bottom greater than a depth of the annular depression, and wherein the material recesses are positioned between mutually adjacent casing-connection bores, the material recesses oriented radially inward toward a central longitudinal axis of the turbine casing and oriented radially inward from a main body of the turbine casing.

2. The turbine casing as claimed in claim 1, wherein the mutually spaced casing-connection bores in the connection flange are arranged in the circumferential direction along at least one circle.

3. The turbine casing as claimed in claim 2, wherein the clamping edge is arranged adjacent to the casing-connection bores in a radial direction.

4. The turbine casing as claimed in claim 3, wherein the adjacent casing-connection bores are surrounded, at least in one section, by connection webs arranged in a manner recessed in an axial direction of the turbine casing with respect to the clamping edge, wherein the material recesses provided between each case of two adjacent casing-connection bores are arranged in a manner recessed in an axial direction of the turbine casing with respect to the connection webs.

5. The turbine casing as claimed in claim 4, wherein the clamping edge has, in a region between two adjacent casing-connection bores, a respective clamping edge recess that widens the annular depression.

6. The turbine casing as claimed in claim 5, wherein a depth of the clamping edge recess coincides with a sum of the depth of the annular depression and a depth of the casing-connection bores provided in the annular depression, and wherein these depths extend in the axial direction of the turbine casing.

7. The turbine casing as claimed in claim 2, wherein the turbine casing is of a multi-piece design.

8. The turbine casing as claimed in claim 7, wherein the clamping edge forms a separate component of the turbine casing.

9. The turbine casing as claimed in claim 7, wherein a heat shield and/or a nozzle ring forms a separate component of the turbine casing.

10. The turbine casing as claimed in claim 9, wherein the clamping edge is part of the heat shield or of the nozzle ring.

11. An exhaust-gas turbine having the turbine casing as claimed in claim 1.

12. The exhaust-gas turbine as claimed in claim 11, wherein the exhaust-gas turbine has a bearing casing connected to the turbine casing, wherein the turbine casing is connected to the bearing casing by connection elements.

13. The exhaust-gas turbine as claimed in claim 12, wherein the exhaust-gas turbine has clamping elements that are each pressed against the connection flange of the turbine casing and against the bearing casing by one or more connection elements.

14. The exhaust-gas turbine as claimed in claim 13, wherein the clamping elements are pressed against the clamping edge.

15. The exhaust-gas turbine as claimed in claim 12, wherein the connection elements are screws or threaded pins.

* * * * *